US008096465B2

(12) United States Patent
Lebeau

(10) Patent No.: US 8,096,465 B2
(45) Date of Patent: Jan. 17, 2012

(54) SAFE DEVICE FOR COLLECTING COINS AND SAFE METHOD FOR TRANSFERRING AND EMPTYING COIN BOXES

(75) Inventor: Christophe Lebeau, Jouy en Josas (FR)

(73) Assignee: Thales (FR)

( * ) Notice: Subject to any disclaimer, the term of this patent is extended or adjusted under 35 U.S.C. 154(b) by 561 days.

(21) Appl. No.: 12/067,741

(22) PCT Filed: Sep. 22, 2006

(86) PCT No.: PCT/EP2006/066646

§ 371 (c)(1),
(2), (4) Date: Sep. 2, 2008

(87) PCT Pub. No.: WO2007/033996

PCT Pub. Date: Mar. 29, 2007

(65) Prior Publication Data

US 2009/0031928 A1 Feb. 5, 2009

(30) Foreign Application Priority Data

Sep. 23, 2005 (FR) ..... 05 09775

(51) Int. Cl.
*G07B 15/00* (2006.01)

(52) U.S. Cl. ..... 232/15; 232/1 D; 232/16; 194/350

(58) Field of Classification Search ..... 232/15, 232/16, 1 D, 43.2, 44; 194/350, 351; 109/47, 109/50, 52, 66; 206/0.81
See application file for complete search history.

(56) References Cited

U.S. PATENT DOCUMENTS

| | | | | | |
|---|---|---|---|---|---|
| 3,175,759 | A * | 3/1965 | Teale et al. | 232/1 R |
| 3,276,835 | A * | 10/1966 | Hall | 312/333 |
| 3,773,252 | A * | 11/1973 | Jensen | 232/1 R |
| 3,926,366 | A * | 12/1975 | Sciortino | 232/15 |
| 4,638,746 | A * | 1/1987 | Ishigure | 109/52 |
| 4,730,715 | A * | 3/1988 | Siegenthaler | 194/351 |
| 5,009,365 | A | 4/1991 | Holtzer | |
| 5,224,579 | A * | 7/1993 | Brown | 194/350 |
| 5,873,446 | A * | 2/1999 | Wei | 194/350 |
| 5,941,364 | A | 8/1999 | Wei | |
| 6,336,544 | B1 * | 1/2002 | Blad et al. | 194/217 |
| 6,409,589 | B1 | 6/2002 | Laconico, Jr. et al. | |

FOREIGN PATENT DOCUMENTS

EP 571188 A2 * 11/1993

* cited by examiner

*Primary Examiner* — William L. Miller

(74) *Attorney, Agent, or Firm* — Lowe Hauptman Ham & Berner, LLP

(57) ABSTRACT

The invention relates to a safe device for collecting coins. It comprises a support receiving a coin box comprising a hatch controlled by an internal mechanism. The coin box comprises includes a locking means making it possible to authorize its introduction and its extraction in the support. The locking means making it possible to authorize the internal mechanism to open the hatch. The internal mechanism acts on the hatch by opening it when the locking means authorizes it and the coin box is introduced into the support; and by holding it closed otherwise. The subject of the invention is also a safe method for emptying coin boxes. The invention is applied to the transfer of coins without contact.

8 Claims, 2 Drawing Sheets

SAFE DEVICE FOR COLLECTING COINS AND SAFE METHOD FOR TRANSFERRING AND EMPTYING COIN BOXES

CROSS-REFERENCE TO RELATED APPLICATIONS

The present Application is based on International Application No. PCT/EP2006/066646, filed on Sep. 22, 2006, which in turn corresponds to French Application No. 05 09775, filed on Sep. 23, 2005, and priority is hereby claimed under 35 USC §119 based on these applications. Each of these applications are hereby incorporated by reference in their entirety into the present application.

FIELD OF THE INVENTION

The invention relates to a safe device for collecting coins as well as to a safe method for transferring and emptying coin boxes. In particular, the invention applies to the transferring of a coin box from a dispenser to a safe collection point where the content of the coin box is emptied, without the personnel having any physical contact with the coins.

BACKGROUND OF THE INVENTION

Numerous automatic points of sale accept coins as a means of payment. Once collected, they are directed and stored within the dispenser in at least one coin box. Once filled, the coin box is replaced by an escorting agent, then escorted to a safe collection point. The coin box is then emptied there.

The operations of collecting and escorting the coin boxes must be done while limiting the possibilities of fraud to the maximum. For this purpose, it is important to limit physical contact and the possibility of seeing the coins in the course of these operations, including in respect of the personnel carrying out the collection and escorting.

A coin box generally comprises a lock prohibiting when it is locked its extraction from the dispenser. Only the personnel carrying out the escorting and collection have the key making it possible to unlock the lock prohibiting extraction. The opening of the coin box is generally barred by another lock. The escorting personnel, not having the key unlocking this other lock, therefore do not have access physically to the coins during extraction of the dispenser and transfer to the collection point.

Once the coin box has reached the collection point, a collection agent has the key allowing him to open the lock barring the opening of the coin box. The collection agent then has access physically to the coins during this operation. There is therefore a possibility of fraud by the collection agent opening the coin box at the collection point.

SUMMARY OF THE INVENTION

The aim of the invention is to alleviate the aforesaid drawbacks. For this purpose, the subject of the invention is a safe device for collecting coins. It comprises a support able to receive at least one coin box. The coin box is closed by a lid comprising a recess that can be obstructed by a hatch. The opening and the closing of the recess by the hatch being controlled by an internal mechanism. The coin box comprises:

- a locking means making it possible to authorize or to prohibit the introduction and the extraction of the coin box in the support;

- a locking means making it possible to give the authorization or the prohibition to open the hatch to the internal mechanism;

The internal mechanism acts on the hatch:

- by opening it when the locking means authorizes it and the coin box is introduced into the support;
- by holding it closed in all other cases.

In one embodiment, the support comprises at least one rod which, when the coin box is introduced into the support, enters the coin box by way of an opening. The rod comes into interaction with the internal mechanism so as to signal to it the introduction of the coin box into the support. The rod can furthermore comprise means allowing it to authenticate itself to the internal mechanism.

Advantageously, the coin box comprises a locking means allowing the maintenance personnel to open the lid of the coin box.

The subject of the invention is also a safe method for transferring a coin box from a point of sale comprising a support to a collection point comprising a support so as to be emptied. The coin box is closed by a lid. The lid comprises a recess that can be obstructed by a hatch. The opening and the closing of the recess by the hatch are controlled by an internal mechanism. The method comprises the following steps:

- authorization, given by a collection agent, to open the hatch;
- authorization, given by an escorting agent, to introduce the coin box into the support of the dispenser;
- introduction of the coin box into the support of the dispenser, the internal mechanism then causing the hatch to open;
- authorization, given by an escorting agent, to extract the coin box from the support of the dispenser, when the coin box has to be emptied,
- extraction of the coin box from the support of the dispenser, the internal mechanism then causing the hatch to close;
- transfer of the coin box to a collection point;
- authorization, given by a collection agent, to open the hatch;
- authorization, given by a collection agent, to introduce the coin box into the support of the emptying machine;
- introduction of the coin box into the support of the emptying machine, the internal mechanism then causing the hatch to open;
- authorization, given by a collection agent, to extract the coin box from the support of the emptying machine;
- extraction of the coin box from the support of the emptying machine, the internal mechanism then causing the hatch to close;
- transfer of the coin box to a point of sale.

In one embodiment, the internal mechanism authenticates the support before proceeding with the opening of the hatch.

Advantageously, the coin box can be opened after authorization given by the maintenance personnel.

The invention has in particular the advantages that it makes it possible to reconcile a high level of security with limited utilization constraints. Furthermore, the invention does not require any significant modification of the already installed dispensers.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE DRAWINGS

Figure 1:
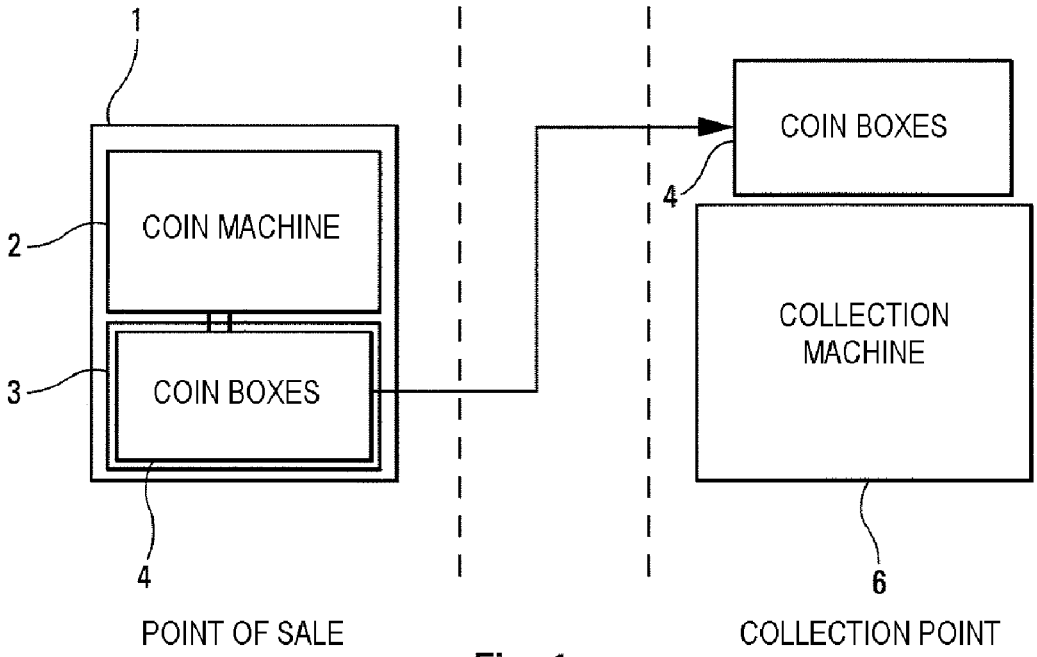
FIG. 1, the transferring of a coin box into an emptying machine according to the state of the art.

FIG. 1 illustrates the transferring of a coin box into an emptying machine according to the state of the art. A dispenser 1 is disposed in a point of sale. The dispenser 1 accepts in particular coins as a means of payment. The coins are introduced into a coin machine 2. The coins are thereafter directed and stored within the dispenser 1 in at least one coin box 4. The coin box 4 comprises a hatch through which the coins enter the coin box 4. The coin box 4 generally has a lock locking the opening of the coin box 4. The coin box 4 is disposed in the dispenser 1 in a support 3 ensuring in particular the interface between the coin machine 2 and the coin box 4. The support 3 generally comprises a locking system with lock making it possible to lock the coin box 4 in the support 3. When the coin box 4 is used to collect the coins, the locking system with lock disposed on the support 3 is locked and therefore prohibits the extraction of the coin box 4 from the support 3.

Once filled, the coin box 4 must be extracted from the support 3 by an escorting agent. The escorting agent has a key making it possible to lock the coin introduction hatch and to unlock the locking system with lock disposed on the interface 3. Once the locking system with lock has been disposed on the unlocked interface 3, the escorting agent can extract the coin box 4 from the interface 3. However, the escorting agent does not have the key allowing him to unlock the lock of the coin introduction hatch disposed on the coin box. The escorting agent therefore cannot have access physically to the coins. The escorting agent transfers the coin box 4 to a collection point.

At the collection point, a collection agent receives the coin box 4. The coin box 4 is thereafter opened by the collection agent who has a key making it possible to unlock the lock disposed on the coin box 4. The collection agent then has access physically to the coins. The coin box is thereafter emptied into a collection machine 6.

Figure 2B:
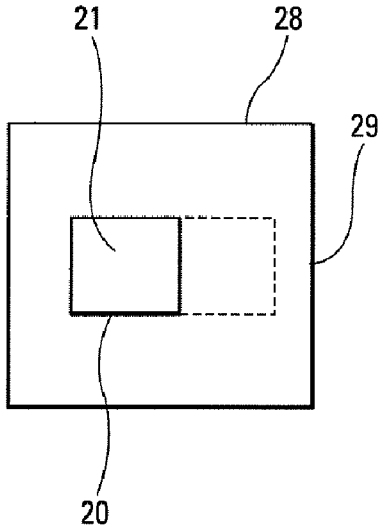
FIG. 2*b*, a coin box according to the invention seen from above.
Figure 2A:
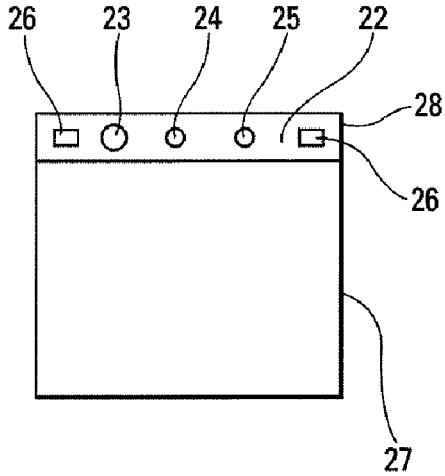
FIG. 2*a*, a coin box according to the invention seen in profile.

FIG. 2*a* and FIG. 2*b* show a coin box according to the invention seen in profile and from above. A coin box 27 comprises in particular a casket, serving as receptacle for the coins, and closed by a lid 28. The lid 28 comprises a recess 20 that can be closed by a hatch 21. The hatch 21 possesses principally two states: a state where it does not obstruct the recess 20 and a state where it totally closes the recess 20. The hatch 21 is actuated automatically by an internal mechanism 29 disposed inside the coin box 27. The coin box 27 can generally be positioned under the coin machine 2 of a dispenser 1. When the hatch 21 does not obstruct the recess 20, the coins coming from the coin machine 2 can enter the coin box 27. The coin box 27 is designed to have significant resistance in relation in particular to the mechanical assaults to which it might be subjected.

The lid 28 furthermore comprises at least one opening 26 allowing the insertion of a rod. The internal mechanism 29 can thus detect the presence or otherwise of a rod in the coin box 27.

The coin box 27 according to the invention furthermore possesses a locking means 23 for controlling the introduction into a support of the coin box 27. The locking means 23 can in particular be a lock accompanied by a corresponding key C1. The locking means 23 operates in collaboration with the internal mechanism 29. The locking means 23 makes it possible either to prohibit or to authorize the introduction of the coin box 27 into a support. For this purpose, when the locking means 23 is locked, the internal mechanism 29 can for example obstruct the opening 26.

The coin box 27 according to the invention furthermore possesses a locking means 24 for locking the hatch 21. The locking means 24 can in particular be a lock accompanied by a corresponding key C2. The locking means 24 operates in collaboration with the internal mechanism 29. The locking means 24 makes it possible either to prohibit or to authorize the opening of the hatch 21. For this purpose, when the locking means 24 is locked, the internal mechanism 29 can for example bar the displacement of the hatch 21 in a position where the hatch 21 obstructs the recess 20.

Advantageously, the coin box 27 according to the invention can possess a locking means 25 for the maintenance of the coin box 27. The locking means 25 can in particular be a lock accompanied by a corresponding key C3. The locking means 25 operates in collaboration with the lid 28. The locking means 25 makes it possible either to prohibit or to authorize the opening of the lid 28. The locking means in particular makes it possible to open the coin box 27 for purposes of maintenance by dedicated maintenance personnel. Maintenance can therefore be carried out by specific maintenance personnel in safe maintenance premises different from the collection point. Only the person responsible for utilization and maintenance has access to the key C3.

In one particular embodiment, the keys C1, C2 and C3 are high-security keys forming part of a hierarchized system of locks. In this case, the key C3 makes it possible to lock or to unlock the locking means 23, 24 and 25. The key C2 makes it possible to lock or to unlock the locking means 23 and 24. The key C1 makes it possible to lock or to unlock the locking means 23.

Figure 3:
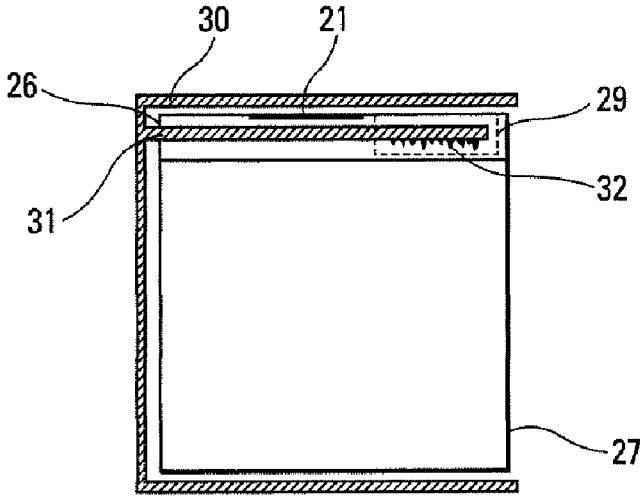
FIG. 3, a coin box support according to the invention.

FIG. 3 shows a coin box support according to the invention. The elements identical to those already presented in the previous figures bear the same references. The support 30 according to the invention is dimensioned to receive a coin box 27 according to the invention. The hatch 21 of the coin box 27 once introduced into the support 30 is no longer accessible from the exterior when the support 30 is fixed under a coin machine 2 or on a collection machine 6. Thus, even when the hatch 21 is open, it is not possible to access the content of the coin box 27. The support 30 comprises in particular a rod 31 disposed in such a way that the rod 31 is introduced into the opening 26 when the coin box 27 is inserted into the support 30. The rod 31 then interacts with the internal mechanism 29. Advantageously, on the part interacting with the internal mechanism 29 the rod 31 comprises authentication means 32. These may in particular be shapes making it possible to identify the rod 32, such as for example hollows disposed in a manner comparable with the shapes of a key. The rod 31 can subsidiarily serve as guidance element for the coin box 27. Moreover, the description alludes to a rod 31. Naturally, the support 30 can comprise several rods comparable with the rod 31.

Figure 4:
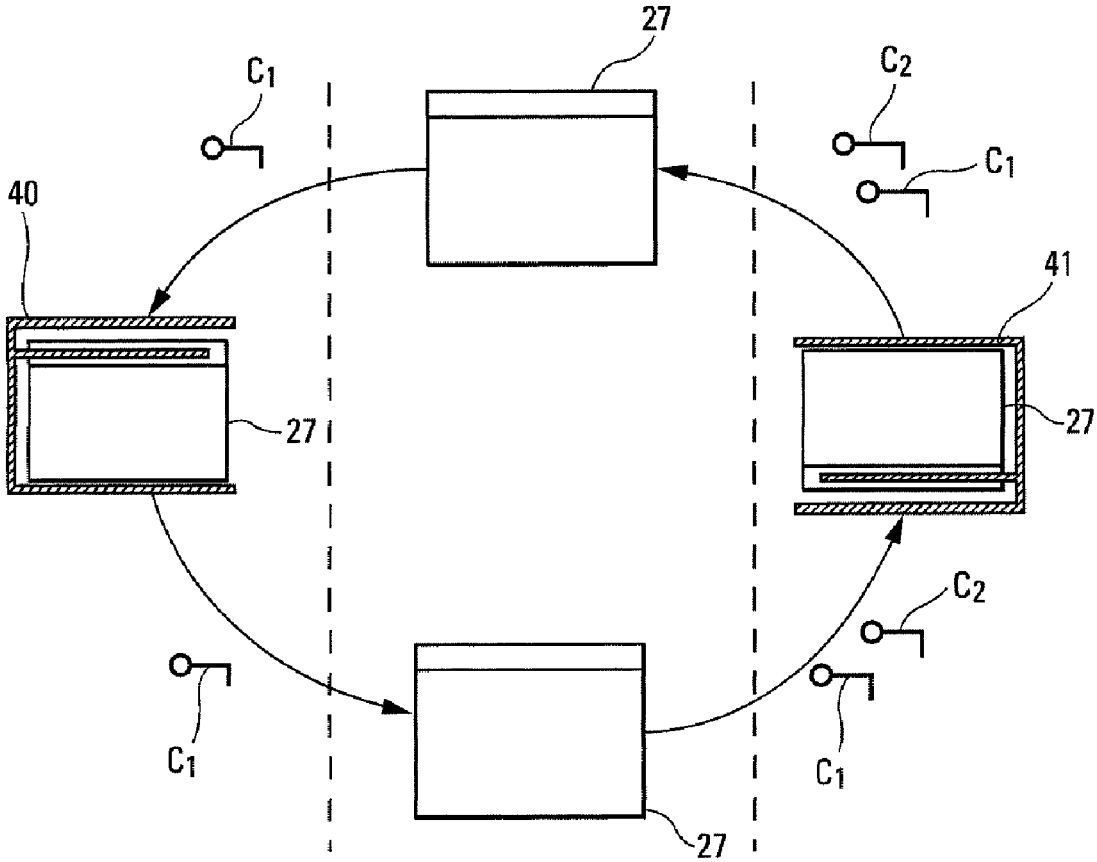
FIG. 4, the safe method for transferring and emptying a coin box according to the invention.

FIG. 4 illustrates the method for safely collecting coins according to the invention. The identical elements already presented in the previous figures bear the same references. In a first phase, the coin box 27 according to the invention collects the coins arising from the coin machine 2 of the dispenser 1. During this phase, the coin box 27 is introduced into a support 40 of the same type as the support 30 according to the invention. The hatch 21 of the coin box 27 is held open by the internal device 29. The coin box 27 is locked by the locking means 23 inside the support 40.

Once the coin box 27 has been filled, an escorting agent must transfer it to the collection point where the box will be introduced and emptied by a collection agent into a support 41 of an emptying machine. The support 41 is of the same type as the support 30 according to the invention.

The coin box 27 has the locking means 23, for example a lock and its key C1, ensuring in particular the locking of the extraction or of the introduction of the coin box 27 in the supports 40 and 41. Thus, once the locking means 23 have been locked and without the key C1, it is not possible to extract the coin box 27 from its support 40. Moreover, once the locking means 23 have been unlocked and without the key C1, it is not possible to introduce the coin box 27 into the support 41.

The coin box 27 has the locking means 24, for example a lock accompanied by a corresponding key C2, making it possible to give the authorization to open the hatch 21 to the internal mechanism 29. Only the possessors of the key C2 can give the authorization to open the hatch 21 to the internal mechanism 29. However, the key C2 alone does not make it possible to open the hatch 21.

The escorting agent has the key C1 allowing him to extract the coin box 27 from its support 40. In a first step, the escorting agent unlocks with the aid of the key C1 the locking means 23 prohibiting the extraction of the coin box 27 from its support 40. This operation is performed at the point of sale. The hatch is secured automatically by the internal mechanism 29. Once the coin box 27 has been extracted, the mechanical device 29 no longer holds open the hatch 21 of the coin box 27. The hatch 21 cannot be opened again without in particular unlocking the locking means 24 with the aid of the key C2. However, the key C2 does not suffice on its own to open the hatch 21.

The coin box 27 thereafter journeys between the point of sale and the collection point. During this journey, the hatch 21 of the coin box 27 cannot be opened. The escorting agent does not have access physically to the coins.

In the collection point, situated in a safe zone, a collection agent receives the coin box 27. The collection agent has the key C1 and the key C2. The collection agent then uses the key C2 on the locking means 24 so as to authorize the opening of the hatch 21 and then he uses the key C1 on the locking means 23 so as to authorize the introduction of the coin box 27 into the support 41 of the emptying machine 6. However, the collection agent cannot open the hatch 21 of the coin box 27. The collection agent therefore does not have access physically to the coins. To empty the coins, it is necessary to introduce the coin box 27 into the support 41 of the emptying machine 6. Only the combination of the authorization to open the hatch 21 given by the key C2, of the authorization to introduce into the support 41 given by the key C1 and the insertion of the coin box 27 into the support 41 makes it possible to open the hatch 21. The emptying of the coins present in the coin box 4 is performed automatically by the emptying machine 6 without intervention of a third party. In one embodiment, the support 41 is disposed in such a way that the hatch 21 of the coin box 27 is oriented downwards: thus through the effect of gravity, when the hatch 21 is opened by the mechanism 29, the coins fall into the emptying machine 6.

Once emptying has terminated, the collection agent uses the key 1 in the locking means 23 to authorize the extraction of the coin box 27 from the support 41 of the emptying machine 6. The coin box 27 is thereafter extracted from the support 41. Once the coin box 27 has been extracted, the internal mechanism 29 no longer holds open the hatch 21 of the coin box 27. The hatch 21 cannot be opened again without in particular unlocking the locking means 24 with the aid of the key C2. The collection agent then uses the key C2 on the locking means 24 to authorize the internal mechanism 29 to open the hatch 21 of the coin box 27.

The coin box 27 emptied and reset then journeys to the point of sale. The coin box 27 is introduced again with the aid of the key C1 into the support 40 of the dispenser 1.

The above description is based on a coin box 27. However, the invention applies equally to any container having to be transferred and then emptied without the content being accessible to the personnel performing these operations.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A safe device for collecting coins, comprising:

a support receiving at least one coin box, said coin box being closed with a lid, the lid comprising a recess that is obstructed by a hatch, the opening and the closing of the recess by the hatch being controlled by an internal mechanism, wherein the coin box includes a first locking means for authorizing or prohibiting the introduction and the extraction of the coin box in the support; and a second locking means for locking the hatch to the internal mechanism;

wherein the internal mechanism is configured to open the hatch to authorize the coin box to be introduced into the support by the first locking means; and the internal mechanism is configured to hold the hatch to be closed, wherein the support comprises at least one means for entering the coin box by way of an opening when the coin box is introduced into the support, said means for entering the coin box being configured to interact with the internal mechanism so as to signal the coin box being introduced into the support.

2. The device as claimed in claim 1, wherein said means for entering the coin box comprises an authentication means for allowing said means for entering the coin box to authenticate to the internal mechanism.

3. The device as claimed in claim 2, wherein the coin box further comprises a third locking means for allowing the lid of the coin box to be opened.

4. A safe device for collecting coins, comprising:

a support receiving at least one coin box, said coin box being closed with a lid, the lid comprising a recess that is obstructed by a hatch, the opening and the closing of the recess by the hatch being controlled by an internal mechanism, wherein the coin box includes a first locking means for authorizing or prohibiting the introduction and the extraction of the coin box in the support; and a second locking means for locking the hatch to the internal mechanism;

wherein the internal mechanism is configured to open the hatch to authorize the coin box to be introduced into the support by the first locking means; and the internal mechanism is configured to hold the hatch to be closed, wherein the support comprises at least one means for entering the coin box by way of an opening when the coin box is introduced into the support, said means for entering the coin box being configured to interact with the internal mechanism so as to signal the coin box being introduced into the support, wherein the coin box further comprises a third locking means for allowing the lid of the coin box to be opened.

5. A safe method for transferring a coin box from a point of sale comprising a support to a collection point so as to be emptied, said coin box being closed by a lid, the lid comprising a recess that is obstructed by a hatch, the opening and the closing of the recess by the hatch being controlled by an internal mechanism, said method comprising the following steps:

authorization, adapted to be given by a collection agent, to open the hatch;

authorization, adapted to be given by an escorting agent, to introduce the coin box into the support;

introduction of the coin box into the support, the internal mechanism then causing the hatch to open;

authorization, adapted to be given by an escorting agent, to extract the coin box from the support, when the coin box has to be emptied, extraction of the coin box from the support, the internal mechanism then causing the hatch to close;

transfer of the coin box to the collection point;

authorization, adapted to be given by a collection agent, to open the hatch;

authorization, adapted to be given by a collection agent, to introduce the coin box into a support of an emptying machine;

introduction of the coin box into the support of the emptying machine, the internal mechanism then causing the hatch to open;

authorization, adapted to be given by a collection agent, to extract the coin box from the support of the emptying machine;

extraction of the coin box from the support of the emptying machine, the internal mechanism then causing the hatch to close; and transfer of the coin box to the point of sale.

6. The method as claimed in claim 5, wherein the internal mechanism is configured to authenticate the support before proceeding with the opening of the hatch.

7. The method as claimed in claim 6, wherein the coin box is opened after authorization adapted to be given by a maintenance personnel.

8. The method as claimed in claim 5, wherein the coin box is opened after authorization adapted to be given by a maintenance personnel.

* * * * *